US005244118A

United States Patent [19]

Fallon, deceased et al.

[11] Patent Number: 5,244,118

[45] Date of Patent: Sep. 14, 1993

[54] GAS BLENDING APPARATUS

[76] Inventors: Merton R. Fallon, deceased, late of Woodland Hills, Calif.; by Edward A. Landry, executor, One Wilshire Blvd., #2000, Los Angeles, Calif. 90017; Thomas Clements, 1739 Clinton Dr., Ambler, Pa. 19002

[21] Appl. No.: 844,283

[22] Filed: Mar. 2, 1992

[51] Int. Cl.[5] ..... B67D 5/00

[52] U.S. Cl. ..... 222/3; 222/57; 222/134; 137/114; 261/DIG. 7

[58] Field of Search ..... 222/3, 55, 57, 61, 145, 222/152, 394, 396, 399, 134; 261/16, 64.3, DIG. 7; 137/88, 114

[56] References Cited

U.S. PATENT DOCUMENTS 3,534,753 10/1970 Ollivier ..... 137/114 X
3,643,677 2/1972 Begleiter ..... 137/114 X
3,738,107 6/1973 Miller ..... 137/114 X
4,015,617 4/1977 Connolly ..... 137/88
4,364,493 12/1982 Raynes et al. ..... 222/399
4,827,965 5/1989 Wates ..... 137/114 X
4,874,116 10/1989 Fallon et al. ..... 222/399
4,928,850 5/1990 Fallon et al. ..... 222/3

*Primary Examiner*—Gregory L. Huson
*Attorney, Agent, or Firm*—J. E. Brunton

[57] ABSTRACT

An apparatus for blending two gases together in precisely adjustable proportions. The apparatus includes a mechanically adjustable, blending subassembly adapted to receive the first gas at a predetermined pressure and a one-to-one force balanced pneumatic relay which is operated by the first gas and which meters the flow of the second gas to the blending subassembly at a pressure substantially equal to the pressure of the first gas being supplied to the blending subassembly. Check valves are strategically located to prevent back flow of either of the gases being mixed when the device is being operated in the low-flow mode, thereby eliminating the requirement for time consuming balancing of the gas flow pressures.

5 Claims, 2 Drawing Sheets

GAS BLENDING APPARATUS

BACKGROUND OF THE INVENTION

1. Field of the Invention

The present invention relates generally to an apparatus for controllably blending gases. More particularly the invention concerns an apparatus for blending gases such as nitrogen and carbon dioxide for use in connection with beverage dispensing systems of the character wherein beverage contained in a bulk container is controllably dispensed therefrom by admission of the gas mixture under pressure to the container.

2. Discussion of the Prior Art

The use of carbon dioxide gas in the dispensing of beverages such as beer, ale or stout is well known. However, it has been found that for certain applications the use of a mixture of carbon dioxide gas and a second gas, such as nitrogen, provides certain advantages. For example, the use of such a mixture alleviates excessive carbonization of the beverage being dispensed and, when used in dispensing beer, advantageously achieves a stable and creamy head on the beer.

While the advantages of using a gaseous mixture of nitrogen and carbon dioxide in dispensing beer has been known for some time, substantial difficulties have been encountered in designing an accurate, reliable and inexpensive device for mixing the nitrogen and carbon dioxide in the correct proportions. One of the most successful devices to accomplish such mixing is disclosed in U.S. Pat. No. 4,874,116 issued to the present inventors. An improvement of the device described in the aforementioned patent is disclosed in U.S. Pat. No. 4,928,850 also issued to the inventors named herein. As will become apparent from the descriptions which follow, the device of the present invention comprises yet a further improvement upon the device described in U.S. Pat. No. 4,928,8550.

Due to the novel design of the apparatus of the present invention, the high-flow element of the device is isolated from the gas flow path when the device is being operated in the low-flow mode. This eliminates the undesirable and time consuming necessity to continuously adjust the balance of the gases being mixed as temperature and shock environments change during operation.

SUMMARY OF THE INVENTION

The apparatus of the present invention is designed to precisely blend together first and second gases in an adjustable proportion. The gaseous mixture produced is automatically provided, on demand, to an external system, such as a beverage dispensing system, in which the beverage is dispensed from a closed container by the pressure of the gaseous mixture.

The apparatus comprises sources of first and second gases under pressure and three major operating components, or sub-systems, namely a flow-control mechanism, a unique one-to-one force balance pneumatic relay and the gas blending, or flow splitting components.

The pressure control mechanism, which is operated by a first gas, such as carbon dioxide, at a predetermined over pressure, functions to control the flow of the second gas, such as nitrogen, toward the pneumatic relay. This mechanism also controls the flow of the second gas toward the blending component of the apparatus. Typically, the first gas enters the inlet of the control mechanism at a pressure of on the order of ten pounds per square inch greater than the required optimum pressure for dispensing beverage from a container.

The pneumatic relay is operated by the second gas flowing from the outlet of the control mechanism. In a manner presently to be described, the second gas functions to control the flow of the first gas toward the gas blending component. An important aspect of the present invention resides in the fact that the novel design of the pneumatic relay guarantees that as the first and second gases are supplied to the gas blending component, the pressures thereof are always maintained substantially equal. This eliminates the need to match the flow regulation characteristics of the supply pressure regulators which function to regulate the supply of the gases from the gas sources to the system.

Another highly important aspect of the present invention is the unique design of the gas blending, or flow splitter, component of the apparatus. This component comprises a hollow tubular body within which is sealably mounted a sintered stainless steel sleeve which divides the hollow body into inner and outer elongated chambers. The sintered sleeve is sufficiently fine to result in a nearly perfect linear gas flow between the chambers. This unique feature enables the device to operate at high accuracy levels, especially at relatively low gas flow rates. In operation, the second gas enters the first end of the inner chamber at a given pressure while the first gas flowing from the pneumatic relay enters the second, or opposite end of the inner chamber at the same identical pressure. Mounted intermediate the ends of the inner chamber, for reciprocal movement therewithin, is a piston-like element having a peripheral O-ring which sealably engages the inner wall of the sintered sleeve. With this arrangement, since the supply pressures of the first and second gases flowing into the opposite ends of the inner chamber of the blending mechanism are equal, the amount of the first gas flowing through the sintered sleeve into the outer chamber of the unit, will depend on the position of the piston within the inner chamber. Similarly, the amount of the second gas flowing into the outer chamber for mixing with the first gas will likewise depend upon the position of the piston within the inner chamber. By adjusting the piston axially within the inner chamber, the wall area of the sintered sleeve available for flow through by the first and second gases can be controllably altered to provide the desired mix of the gases in the outer chamber. The gaseous mixture is then available from the second chamber upon demand of the external system.

It is to be observed that since the supply pressures of the first and second gases to the inner chamber are identical, as gas flow is demanded by the external system, the identical pressure drops induced through the wall of the sintered sleeve guarantee that the gas flow of each constituent gas will be directly proportional to the wall area of the sleeve available for that gas to flow through. Because of the novel configuration of the blending mechanism and the laminar flow provided by the sintered sleeve, as the area for flow of the first gas is increased by axial movement of the piston, the area for flow of the second gas is correspondingly decreased. With this construction, it is a simple matter to associate a calibrated scale with the reciprocating, selectively movable piston so that the percentages by volume of the constituent gases in the gaseous mixture can be read directly for each position of the piston within the inner chamber.

Several important safety features of the apparatus such as automatic shut down and feed back control are inherent in the design shown in the drawings. These features will be discussed in detail in the paragraphs which follow.

With the foregoing brief description of the invention in mind, an object of the present invention is to provide a gas blending device in which first and second gases can readily be blended together in precisely adjustable proportions with the gaseous mixture thus formed being automatically provided to an external system only upon the demand of the external system.

It is another object of the invention to provide a gas blending device of the aforementioned character in which the gases can be precisely blended without the necessity of attempting to match the flow regulation characteristics of supply pressure regulators which regulate the flow of the two gases from the gaseous sources toward the apparatus.

Another object of the invention is to provide a device as described in the preceding paragraphs which includes a novel one-to-one, force-balanced pneumatic relay which is in communication with the gas blending component of the device and which is operated by the first gas at a predetermined pressure optimum for operation of the external system. Because of the novel force balancing feature of the pneumatic relay, the device meters the flow of the second gas to the blending component at a pressure which is always substantially equal to the operating pressure of the first gas.

A further object of the invention is to provide an apparatus of the character described in which the gas blending component of the apparatus receives the gas from one of the gas sources at an optimum supply system operating pressure, receives the other gas from the pneumatic relay at the same pressure and then precisely mixes the two gases in a proportion determined by the position of a mechanically adjustable, piston-like device sealably carried within the gas blending component.

Still another object of the invention is to provide an apparatus of the type described in the preceding paragraphs in which the high-flow element is isolated from the gas-flow path when the device is being operated in the low-flow mode. This important improvement prevents the "back-flow" of either of the gases being mixed in the low-flow mode of operation while not impeding the normal forward flow of the gases during the normal high-flow mode of operation.

DESCRIPTION OF THE INVENTION

Figure 1:
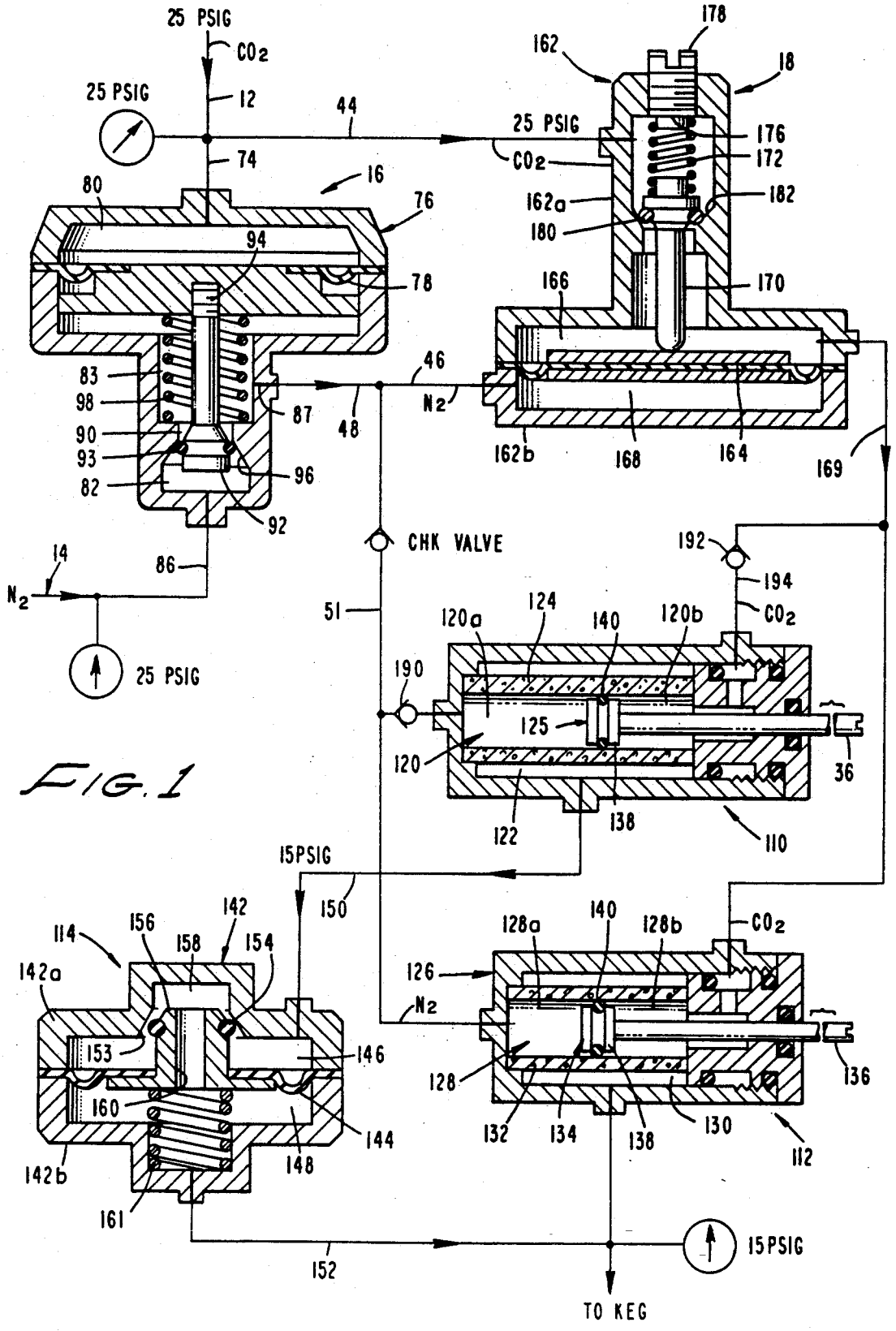
FIG. 1 is a generally schematic representation of the improved gas blending apparatus of the invention.
Figure 2:
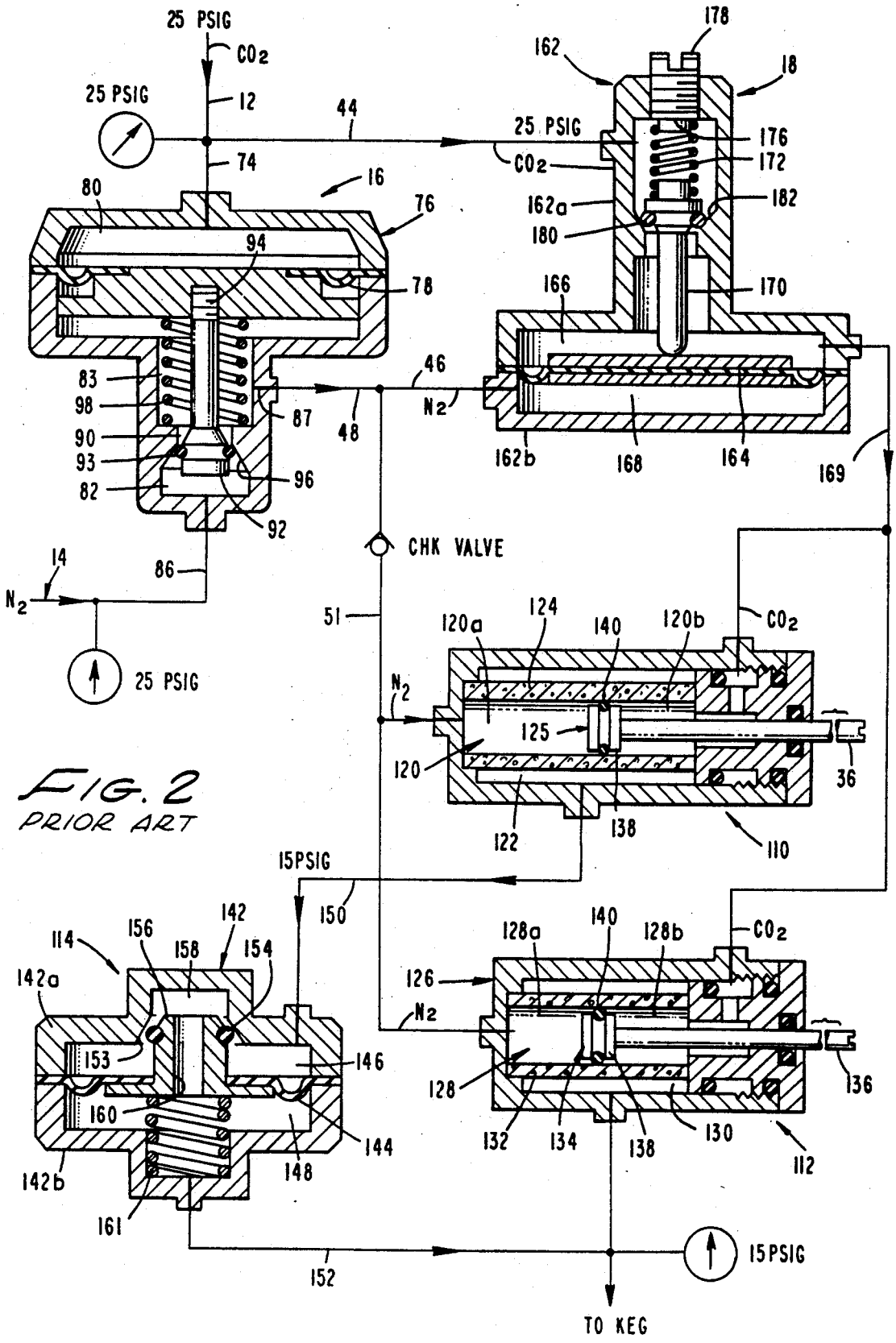
FIG. 2 PRIOR ART
FIG. 2 is a generally schematic representation of the prior art gas blending apparatus disclosed in U.S. Pat. No. 4,928,850 issued to the present inventors.

Referring to FIG. 1 of the drawings, the apparatus of the invention can be seen to be similar in many respects to the apparatus described in U.S. Pat. No. 4,928,850, the specification of which is hereby incorporated herein by reference. The apparatus of this embodiment of the invention comprises a source of a first gas under pressure 12, such as carbon dioxide, a source of a second gas under pressure 14, such as nitrogen, and five major operating sub-systems. These major operating sub-systems, which in practice, are disposed within a suitable compact housing, comprise a pressure control mechanism 16, a one-to-one force balanced pneumatic relay 18, a gas blending, or flow splitting, means having high and low flow rate stages 110 and 112, and a differential pressure control means here provided as a differential pressure controller 114.

The gas blending means functions to controllably mix the first and second gases and is in communication with the keg, or other closed container, from which the beverage is to be dispensed by the pressure of the gaseous mixture. The keg is, in turn, interconnected with a dispensing valve arrangement, or beer dispensing faucet (not shown) in a manner well-known to those skilled in the art. With this construction, the gaseous mixture will flow on demand of the external system from the gas blending means through a conduit 116 and into the keg whereby the beer will be forced out of the dispensing faucet.

Referring to the lower, right-hand portion of FIG. 1, the high flow stage 110 of the gas blending means comprises a housing 118 having a first, or inner, chamber 120 and a second, or outer, chamber 122. These chambers are divided by a porous member, provided here in the form of a sintered stainless steel sleeve 124. Sleeve 124 is tubular in shape and the ends thereof are disposed in sealable engagement with internal walls of the housing 118 using elastomeric O-rings or other suitable sealing means. Sleeve 124 is constructed of a material having a multiplicity of very fine pores which insure a substantially perfect laminar flow of gases therethrough. With this construction, outer chamber 122 takes the form of an elongated, annularly shaped, closed chamber which can communicate only with inner chamber 120 only through the small pores provided in the sintered sleeve 124.

Disposed within inner chamber 120 is a reciprocal means, or piston assembly 125, which is axially movable within chamber 120 from a first to a second position, thereby functioning to divide the inner chamber into first and second portions **120*a* and 120*b*** of proportionally varying volume.

The low flow stage 112 of the gas blending means comprises a housing 126 having a first, or inner, chamber 128 and a second, or outer, chamber 130. These chambers are divided by a porous member, provided here in the form of a sintered stainless steel sleeve 132. Sleeve 132 is tubular in shape and the ends thereof are disposed in sealable engagement with internal walls of the housing 126 using elastomeric O-rings or other suitable sealing means. Sleeve 132, like sleeve 124, is constructed of a material having a multiplicity of very fine pores, but offering a different impedance from that cf sleeve 124. With this construction, outer chamber 130 takes the form of an elongated, annularly shaped, closed chamber which can communicate only with inner chamber 128 only through the small pores provided in the sintered sleeve 132.

Disposed within inner chamber 128, is a reciprocal means, or piston assembly 134, which is axially movable within chamber 128 from a first to a second position, thereby functioning to divide the inner chamber into first and second portions **128*a* and 128*b*** of proportionally varying volume.

In the present form of the invention, both piston assemblies comprise an elongated shaft 136 which carries at one end a piston-like member 138 having at its periphery a yieldably resistant elastomeric O-ring 140 which engages and slides along the inner walls of the sleeves 124 and 132. The shafts are axially movable in precise increments to cause the pistons 138 to move axially within their respective chambers in very small, precisely controllable increments.

This form of the invention also includes the one-to-one, forced balanced pneumatic relay 18. The inlet of pneumatic relay means 18 is in communication with the first gas source 12 by means of conduit 44. Relay means 18 is also in communication with the second gas source 14 by means of a conduit 46 which in turn communicates with control means 16 via a conduit 48. Once again, the second gas 14 functions as the operating gas which operates the relay to permit the flow of first gas 12 to the gas blending means. The basic function of the pneumatic relay means is to supply the first gas 12 to the gas blending means upon demand resulting from the beverage being dispensed from the container 22.

The fifth sub-system of the apparatus of the invention, namely the differential pressure controller 114, functions to separate the operation of the two stages 110 and 112 of the gas blending means. Controller 114 comprises a hollow body 142 having first and second interconnected body portions **142*a* and 142*b*, and a diaphragm 144 disposed intermediate thereof. Diaphragm 144 divides hollow body 142 into two chambers 146 and 148. Chamber 146 is in communication with first stage 110 of the gas blending means via conduit 150 and chamber 148 is in communication with the keg via conduit 152**.

Portion **142*a* is provided with an internal valve seat 152 which is inter-engaged by an O-ring 154 carried by a valving member 156. Valving member 156 is operably associated with diaphragm 144 and functions to control the flow of gas from chamber 146 into a subchamber 158 and through the central passageway 160 provided in the valving member, which passageway is in communication with chamber 148. A control biasing means, shown here as a spring 161, is carried within chamber 148 and functions to normally urge O-ring 154 into sealing engagement with seat 153. So long as the gas pressure within chamber 146 is less than the gas pressure within chamber 148, plus the pressure exerted by spring 161 on diaphragm 144, the valve member 156 will remain in engagement with seat 153 blocking the flow of gas toward the keg. However, upon a pressure drop within the keg of a predetermined magnitude, the valve member will move away from seat 153 permitting gas to flow from stage 110** toward the keg.

The pneumatic relay means 18 of the present embodiment of the invention comprises a hollow body 162 having first and second portions **162*a* and 162*b* and a first diaphragm 164 mounted within second portion 162*b* to divide it into first and second pressure chambers 166 and 168 respectively. Chamber 168 is in communication with sub-system 16 via conduit 46, while chamber 166 is in communication with the gas blending means via a conduit 169**.

The valving means of the pneumatic relay 18 is of unique design and comprises a first pressure port means, or valve member 170, which is operably associated with diaphragm 164 and functions to control the flow of the first gas 12 into chamber 166. Valve member 170 is movable from a closed position to an open position upon movement of the diaphragm 164 from its first at rest position to its second deflected position in response to pressure exerted thereon by the second gas 14 flowing through conduit 46. To yieldably resist movement of the diaphragm toward the second position, there is provided biasing means, shown here in the form of a coiled spring 172, which is disposed intermediate valve member 170 and a spring seat 176 which is formed by the lower surface of a threaded adjustment member 178. Member 178 is threadably receivable within portion **162*a* of hollow body 162 so that the compressive forces exerted by spring 172** can be precisely adjusted.

Valve member 170 carries an O-ring 180 which is adapted to sealably engage a valve seat 182 formed internally of portion **162*a*. In operation, when the force of the gas 14 acting upon diaphragm 164 is sufficient to overcome the urging of spring 172, the gas 12 will flow past seat 182 into chamber 166 and will act against diaphragm 164 to tend to counterbalance the force of gas 14 acting on the opposite side of diaphragm 164**.

The pressure control mechanism 16 of this form of the invention comprises a hollow control valve housing 76 within which is mounted a second diaphragm 78. Diaphragm 78 divides housing 76 into first and second chambers 80 and 82 respectively. First chamber 80 has an inlet in communication with the source of the first gas source 12 by means of a conduit 74 which, in turn, is interconnected with conduit 44. In like manner, second chamber 82 is provided with an inlet which is in communication with the source of second gas source 14 under pressure by means of a conduit 86. Second chamber 82 communicates through a valving means with a chamber 83. Chamber 83 is provided with an outlet 87 which is in communication with the gas blending means via a conduit 51 and with the pneumatic relay means via conduits 46 and 48.

Forming the operating portion of the pressure control means 16 is a second pressure port means 90 comprising a second valve member 92 which is operably associated with diaphragm 78. Means 90 functions to control the flow of the second gas 14 from chamber 82 to chamber 83 and thence toward the pneumatic relay means upon movement of the second diaphragm 78 from a first closed position to a second open position in response to pressure exerted on the diaphragm by first gas 12. Second valve member 92 is interconnected with diaphragm 78 by means of a connector stem 94. When the valve is in a closed position, elastomeric O-ring 93 of the valve member 92 is in sealable engagement with a valve seat 96 formed within valve housing 76.

To yieldably resist movement of diaphragm 78 toward the valve open position, there is provided biasing means in the form of a coil spring 98 which is disposed intermediate valving member 92 and an interior wall of control valve housing 76. The spring 98 is sized to provide an upward bias force such that at balance the pressure in chamber 83 will always be 10 pounds per square inch (p.s.i.) less than the first gas pressure applied to chamber 80. Thus, if first and second gases are supplied at, for example, 25 p.s.i.g. to the inlets of both the control means and the pneumatic relay means, the output of the control means will be 15 p.s.i.g. This pressure ($N_2$) feeds both chambers **120*a* and 128*a* of the first and second stages of the blending means, as well as input chamber 168 of the pneumatic relay means. The pneumatic relay means output ($CO_2$) will also be exactly 15 p.s.i.g. to chambers 120*b* and 128*b*** of the first and second stages of the gas blending means. This arrangement makes it possible to use the first gas ($CO_2$) as the primary pressure signal source for the complete system.

In operation, the regulator which regulates the flow of the second gas 14 toward the pressure control means, is set ten p.s.i. higher than the required operating pressure optimum for dispensing the beverage from the keg, for example, 25 p.s.i.g. At the same time, the regulator which regulates the flow of the first gas 12 toward the pressure control means and the pneumatic relay means, is also set to approximately ten p.s.i. higher than the required optimum pressure for dispensing the beverage from the keg, for example, 25 p.s.i.g. The overpressure of the first gas 12 accomplishes two things. First, the gas 12 at an over-pressure will flow through conduit 74 into chamber 80 of the pressure centro means. This will cause diaphragm 78 to deflect in a manner which will separate valve member 92 from seat 96, permitting gas to flow from chamber 80 into chamber 83 and thence into outlet conduit 48. Secondly, and simultaneously, gas 12 flowing at the overpressure will flow through conduit 44 into the inlet of pneumatic relay 18.

The second gas 14 flowing outwardly from the control means 16 through conduit 48 will flow into chambers 120*a* and 128*a* of the high and low flow stages of the gas blending means via conduit 51 at the prescribed beverage dispensing operating pressure. The second gas 14 will also flow through conduit 46 into chamber 168 of the pneumatic relay means. The second gas flowing into chamber 168 will cause deflection of diaphragm 164, moving O-ring 180 away from seat 182, thus permitting the first gas 12, which is flowing into the pneumatic relay means via conduit 44, to flow past seat 182 into chamber 166 of the pneumatic relay means. The first gas will then flow from chamber 166 through conduit 169 into chambers 120*b* and 128*b* of the high and low flow and second stages of the gas blending or flow-splitting mechanism. It is important to note that, should the pressure of the gas within chamber 166 exceed the pressure of the second gas flowing into chamber 168, the diaphragm will be deflected in a manner to move the valve member 170 into a closed position. It therefore follows that with the unique design of the pneumatic relay means, the first gas flowing from the relay means toward the gas blending means will always be at a pressure identical to the pressure of the second gas 14, which functions as the operating gas flowing into chamber 168 to deflect diaphragm 164 into a valve opening position.

In operating the apparatus of FIG. 1, assume for purposes of illustration that the low gas flow rate will be on the order of 20% of the maximum rated gas flow rate. Assume, also, that the total gas flow rate will be 10 liters/minute, and the corresponding pressure drop will be on the order of 2 p.s.i. It follows then that the first stage pressure/flow characteristic will be approximately 2 p.s.i./2 liters/minute and the second stage will be 2 p.s.i./10 liters/minute.

In order to separate the operation of the two stages 110 and 112, the differential pressure controller 114 must be included in the apparatus in the manner shown in the drawing. In accordance with the aforementioned assumptions, the nature of controller 114 is such that it remains closed at differentials of 2 p.s.i. or less. The result of this is that at gas flow rates less than 2 liters/-minute, the flow will be solely through low-flow stage 112, stage 110 being cut off by controller 114. At low flow rates then, any tracking error in the relay 18 will be substantially reduced because of the steep pressure/-flow characteristic of the low-flow stage. To illustrate, assume a flow rate of 0.5 liter/minute. Assume, also, that the $CO_2$ pressure delivered by relay 18 differs from the $N_2$ pressure by 0.5 inches of water. Since, at this flow rate the drop across the low flow splitter of 0.5 p.s.i. (14 inches of water) the blend will be in error by 0.5/14 or 3.57% of the adjusted blend. If the blend happens to be set at 30%, the resulting error would produce a blend of 30 plus or minus 1.07%. If the high flow rate stage were used for this flow rate, the error would be 0.5/2.8" $H_2O$ or 17.86%. At a 30% blend, the result would be 30±5.36% or 5 times the error occurring in the first case.

Considering now the situation wherein the total flow rate is such that the high-flow stage 110 has come into operation, but is passing only a small portion of the total flow rate. By way of example, assume a total flow rate of 2.5 liters/minute. Two (2) liters/minute will pass through the low-flow stage 112 and 0.5 liters/minute through the high-flow state 110, combining in the outlet passage for a total of 2.5 liters/minute. As before, assumed error at 0.5 liters/minute through the high-flow stage will be 0.5/2.8 inches of $H_2$ or 17.86% of the adjusted blend. The arithmetic is as follows:

$$30\% \times 0.1786 = \pm 5.36\% \textit{ absolute error}$$

$$\text{Final blend} = \frac{2\,(30) + 0.5\,(30 \pm 5.36)}{2.5} = 30 \pm 1.07\%$$

If the total flow of 2.5 liters/minute were passing through the high-flow stage alone, it can be shown that the final blend would be 30±1.07%.

It is to be noted that check valve 19 is inserted into the flow line that interconnects chamber 120 of the high-flow stage 110 with passageway 51. Similarly, check valve 192 is inserted into passageway or line 94 leading to the high-flow stage. The addition of these strategically located check valves overcomes a problem that was discovered during the commercialization of the apparatus described in U.S. Pat. No. 4,928,850. More particularly, it can be seen that without check valves 190 and 192, when the apparatus is operating in the low-flow mode, that is, when the differential pressure controller 114 is closed, there exists an unwanted flow path through the high-flow element 124. If the gas pressures, for example, the $N_2$ and $CO_2$ pressures entering at 120*a* and 120*b* are precisely balanced and equal, this path is of no consequence. However, in practice, it has been found to be most undesirable and very time consuming to adjust this balance, and environmental changes such as shock, temperature, drift, etc., may alter this precise balance of $N_2$ and $CO_2$ pressures.

To illustrate, if the $N_2$ pressure at chamber 120*a* is fractionally greater than the $CO_2$ pressure at chamber 120*b*, there will be an $N_2$ flow from chamber 120*a* radially outward through wall 124 into space 122 and thence radially inward through wall 124 into chamber 120*b* and through the connecting conduit to the low-flow element where it will join the out flow stream going to the keg. It follows, then, that at low flow rates, this small preponderance of $N_2$ can cause a substantial error in the desired blend of $N_2$ and $CO_2$. It is to be noted that since the flow impedance through the high-flow element 124 is approximately one-fifth that through the low-flow element 132, a small imbalance between $N_2$ and $CO_2$ pressures at chambers 120*a* and 120*b* can introduce large percentage errors in the blend ratio. It is easily shown that a small preponderance of $CO_2$ pressure at 120*b* over the $N_2$ pressure at 120*a* will conversely introduce a large percentage error in the opposite direction.

To avoid this undesirable situation, it is necessary to isolate the high-flow element 124 from the flow path when the device is operating in the low-flow mode. This is accomplished by introducing check valves 190 and 192 into the system in the manner shown in FIG. 1. These additional check valves uniquely prevent the "back flow" of either $N_2$ or $CO_2$ in the low-flow mode of operation while at the same time in no way impeding the normal forward flow of $N_2$ or $CO_2$ in the normal high-flow mode.

For the most accurate operation, it is preferable that the pressure/flow characteristics of check valves 190 and 192 be matched to prevent blend ratio errors in the flow region where the differential pressure controller has just opened and the pressure differential across the high-flow element is still relatively low.

Having now described the invention in detail in accordance with the requirements of the patent statutes, those skilled in the art will have no difficulty in making changes and modifications in the individual parts or their relative assembly in order to meet specific requirements or conditions. Such changes and modifications may be made without departure from the scope and spirit of the invention, as set forth in the following claims.

We claim:

1. An apparatus for supplying a gaseous mixture to an external system on demand, comprising:

(a) a source of a first gas under pressure;

(b) a source of a second gas under pressure;

(c) a gas blending means in communication with the external system and in communication with said sources of said first and second gases for adjustably blending said gases into a gaseous mixture of predetermined proportions and for supplying said gaseous mixture to the external system on demand, said gas blending means comprising a high-flow rate stage and a low-flow rate stage, said high-flow rate stage comprising:

(i) a hollow housing;

(ii) a porous member disposed within said hollow housing so as to define first and second contiguous chambers;

(iii) a first inlet to said first chamber in communication with said source of said first gas;

(iv) a second inlet to said first chamber in communication with said source of said second gas;

(v) reciprocal means disposed in sealable engagement with said porous member for reciprocal movement within said first chamber said reciprocal means being disposed intermediate said first and second inlets; and (vi) an outlet from said second chamber;

(d) pneumatic relay means in communication with said high-flow rate and low-flow rate stages of said gas blending means and said sources of said first and second gases for supplying said second gas to said gas blending means on the demand of the external system, said pneumatic relay means including first valving means operable by said first gas under pressure for controlling the flow of said second gas to said gas blending means upon the demand of the external system;

(e) differential pressure control means in communication with said high flow rate stage of said gas blending means and with said external system for controlling the flow of gases between said high-flow rate stage and said external system;

(f) control means in communication with said sources of said first and second gases for controlling the flow of said first gas to said pneumatic relay means, said control means including second valving means operable by said second gas under a predetermined elevated pressure for controlling the flow of said first gas to said pneumatic relay means;

(g) a first check valve disposed intermediate said pneumatic relay means and said first inlet to said first chamber of said high-flow rate stage to block the flow of gas toward said pneumatic relay means; and (h) a second check valve disposed intermediate said control means and said second inlet of said first chamber of said high-flow rate stage to block the flow of gas from said first chamber of said high-flow rate stage.

2. An apparatus as defined in claim 1 in which said differential pressure control means comprises a first chamber having an inlet connected to said high-flow rate stage, a second chamber having a gas outlet connected to said external system and a valving means disposed intermediate said first and second chambers for preventing gas under pressure from flowing through said gas inlet toward said gas outlet.

3. An apparatus as defined in claim 2 in which said differential pressure control means further includes biasing means for yieldably maintaining said valving member in a closed position until the gas pressure within said first chamber exceeds the gas pressure within said second chamber by a predetermined amount.

4. An apparatus for supplying a gaseous mixture to an external system on demand, comprising:

(a) a source of a first gas under pressure;

(b) a source of a second gas under pressure;

(c) a gas blending means in communication with the external system and in communication with said sources of said first and second gases for adjustably blending said gases into a gaseous mixture of predetermined proportions and for supplying said gaseous mixture to the external system on demand, said gas blending means comprising a high-flow rate stage and a low-flow rate stage, said high-flow rate stage comprising:

(i) a hollow housing (ii) a porous member disposed within said hollow housing so as to define first and second contiguous chambers;

(iii) a first inlet to said first chamber in communication with said source of said first gas;

(iv) a second inlet to said first chamber in communication with said source of said second gas;

(v) reciprocal means disposed in sealable engagement with said porous member for reciprocal movement within said first chamber said reciprocal means being disposed intermediate said first and second inlets;

(vi) an outlet from said second chamber; and said low-flow rate stage comprising:

(i) a hollow housing;

(ii) a porous member disposed within said hollow housing so as to define first and second contiguous chambers;

(iii) a first inlet to said first chamber in communication with said source of said first gas and in communication with said first inlet of said high-flow rate stage;

(iv) a second inlet to said first chamber in communication with said source of said second gas;

(v) reciprocal means disposed in sealable engagement with said porous member for reciprocal movement within said first chamber said reciprocal means being disposed intermediate said first and second inlets; and (vi) an outlet from said second chamber;

(d) pneumatic relay means in communication with said high-flow rate and low-flow rate stages of said gas blending means and said sources of said first and second gases for supplying said second gas to said gas blending means on the demand of the external system, said pneumatic relay means including first valving means operable by said first gas under pressure for controlling the flow of said second gas to said gas blending means upon the demand of the external system;

(e) differential pressure control means in communication with said high flow rate stage of said gas blending means and with said external system for controlling the flow of gases between said high-flow rate stage and said external system;

(f) control means in communication with said sources of said first and second gases for controlling the flow of said first gas to said pneumatic relay means, said control means including second valving means operable by said second gas under a predetermined elevated pressure for controlling the flow of said first gas to said pneumatic relay means;

(g) a first check valve disposed intermediate said pneumatic relay means and said first inlet to said first chamber of said high-flow rate stage to block the flow of gas toward said pneumatic relay means; and (h) a second check valve disposed intermediate said control means and said second inlet of said first chamber of said high-flow rate stage to block the flow of gas from said first chamber of said high-flow rate stage.

5. An apparatus as defined in claim 4 in which said differential pressure control means permits gas flow to said external system only when rate of fluid flow through said low-rate stage exceeds a predetermined amount.

* * * * *